US007900382B2

(12) United States Patent
Wood

(10) Patent No.: US 7,900,382 B2
(45) Date of Patent: Mar. 8, 2011

(54) APPARATUS AND METHOD FOR CUTTING A PATHWAY

(76) Inventor: David Wood, Brownsburg, IN (US)

( * ) Notice: Subject to any disclaimer, the term of this patent is extended or adjusted under 35 U.S.C. 154(b) by 0 days.

(21) Appl. No.: 12/348,834

(22) Filed: Jan. 5, 2009

(65) Prior Publication Data

US 2009/0172977 A1 Jul. 9, 2009

Related U.S. Application Data

(60) Provisional application No. 61/018,750, filed on Jan. 3, 2008.

(51) Int. Cl.
*E02F 3/64* (2006.01)

(52) U.S. Cl. ..... 37/381

(58) Field of Classification Search ..... 37/142.5, 37/352–358, 360–362, 93, 381–393; 171/127, 171/14–16, 45–47, 123, 141, 63, 65; 405/179
See application file for complete search history.

(56) References Cited

U.S. PATENT DOCUMENTS

| | | | | |
|---|---|---|---|---|
| 2,298,671 | A * | 10/1942 | Bayes | 37/389 |
| 2,309,623 | A * | 1/1943 | Armington | 37/389 |
| 4,109,336 | A * | 8/1978 | Ford | 15/3 |
| 4,802,293 | A * | 2/1989 | Smith | 37/381 |
| 5,479,726 | A * | 1/1996 | Bishop | 37/142.5 |
| 6,073,701 | A * | 6/2000 | Kleinemenke | 171/31 |
| 7,034,666 | B2 * | 4/2006 | Knutson | 340/431 |
| 7,165,628 | B2 * | 1/2007 | Taylor et al. | 171/129 |
| 7,412,817 | B2 * | 8/2008 | Flora et al. | 56/328.1 |

* cited by examiner

*Primary Examiner* — Robert E Pezzuto
(74) *Attorney, Agent, or Firm* — Law Office of J D Pemberton; John Pemberton

(57) ABSTRACT

A system and method to cut a path in the ground with a path cutter. The path cutter includes a cutting edge to cut a path and loosen earth and a moldboard angled such that any earth loosed by the moldboard and the cutting edge is pushed towards the center of the moldboard. The width of the cut path is adjusted by an adjustment member attached to the cutting edge and the moldboard. A first auger moves the earth, weeds, rocks and other material loosed by the cutting edge and the moldboard to a front conveyor belt. The material on the first conveyor belt is transferred to a second conveyor belt by a second auger. The material on the second conveyor belt is discharged from the path cutter away from the cut path.

19 Claims, 3 Drawing Sheets

APPARATUS AND METHOD FOR CUTTING A PATHWAY

CLAIM OF PRIORITY

This application claims the benefit of U.S. Provisional Application No. 61/018,750 filed on Jan. 3, 2008 which is incorporated herein by reference.

TECHNICAL FIELD

The object of the invention is to provide an apparatus for building sidewalks and roads and more particularly to an apparatus for cutting a pathway for a sidewalk or road.

DESCRIPTION OF RELATED ART

Sidewalks or pathways existed in Roman times as elevated stone walkways alongside the streets where honorable citizens could walk safely and unsoiled by spattered mud from hurrying legionnaires and chariots. Today, in the United States, the most common type of sidewalk or pathways consists of a poured concrete ribbon with cross-lying strain relief grooves. In addition, brick sidewalks or pathways are found in some urban areas, usually for aesthetic purposes. One element almost all sidewalks or pathways have in common is the need to dig into the ground so the foundation of the sidewalk or pathways can be created. Unfortunately, there is not a relatively easy method or system of digging into the ground when creating relatively long sidewalk or pathways.

SUMMARY OF INVENTION

In a particular illustrative embodiment, a system is disclosed that includes a path cutter that is pulled by a tractor. The path cutter includes a cutting edge to cut a path and loosen earth. The path cutter also includes a moldboard angled such that any earth 5 loosed by the moldboard and the cutting edge is pushed towards the center of the moldboard. The width of the cut path is adjusted by an adjustment member attached to the cutting edge and the moldboard. A first auger moves the earth, weeds, rocks and other material loosed by the cutting edge and the moldboard to a front conveyor belt powered by a first orbit motor. The material on the first conveyor belt is transferred to a second 10 conveyor belt by a second auger. The second conveyor belt is powered by a second orbit motor. The material on the second conveyor belt is discharged away from the cut path.

In a particular illustrative embodiment, a method is disclosed that includes identifying an area to cut a path and determining a path route. A path cutter is set up to cut the path with a desired width and depth. The width of the path is determined by adjusting an adjustment member on the path cutter wherein the adjustment member contains a cutting edge and a moldboard. The depth of the path is determined by the amount of hydraulics used to support the weight of the path cutter. For example, the deeper the path to be cut, the less the hydraulics are used to support the path cutter and the more the weight of the path cutter is unsupported, resulting in a deeper path cut. The shallower the path to be cut, the more the hydraulics are used to support the path cutter and the more the weight of the path cutter is supported, resulting in a shallower path cut. The path cutter is pulled along the path route to cut the path and the path cutter contains the adjustment member, a first auger to move material loosened by the cutting edge and the moldboard to a first conveyor belt, and a second auger to move the loosened material on the first conveyor belt to a 25 second conveyor belt. The material on the second conveyor belt is then discharged away from the cut path.

DETAILED DESCRIPTION OF THE DRAWINGS

Figure 1:
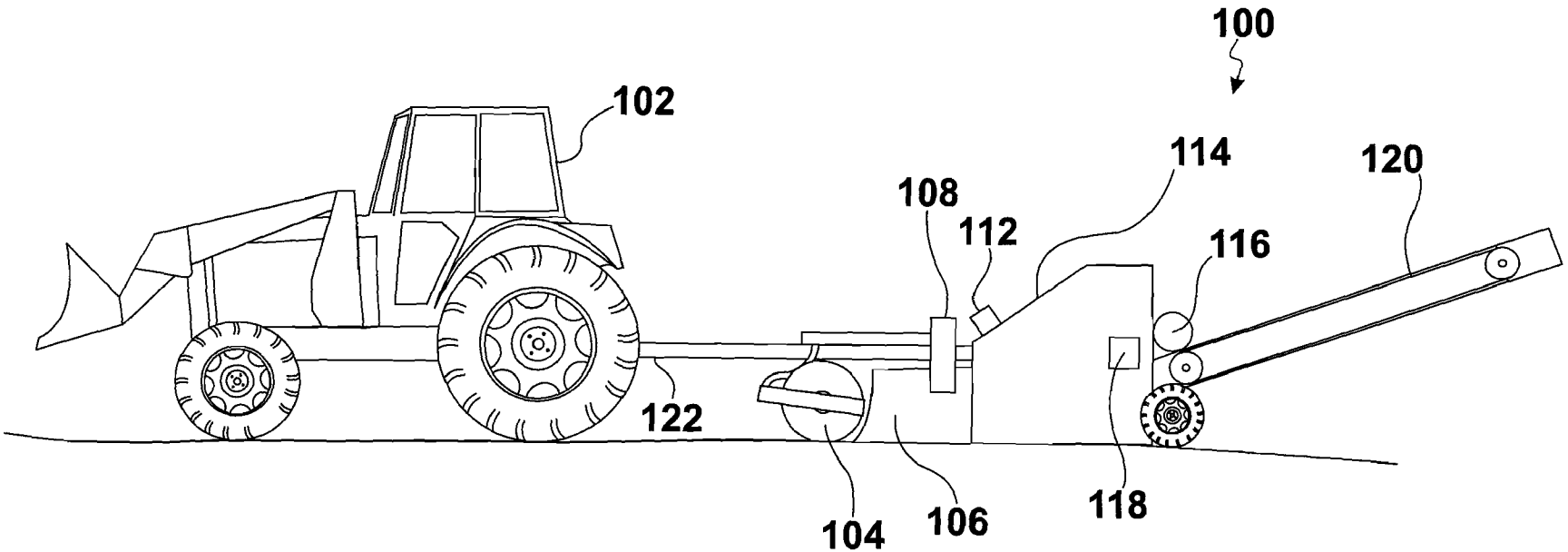
FIG. 1 is a block diagram of a particular illustrative embodiment of a system to cut a path in the ground.
Figure 2:
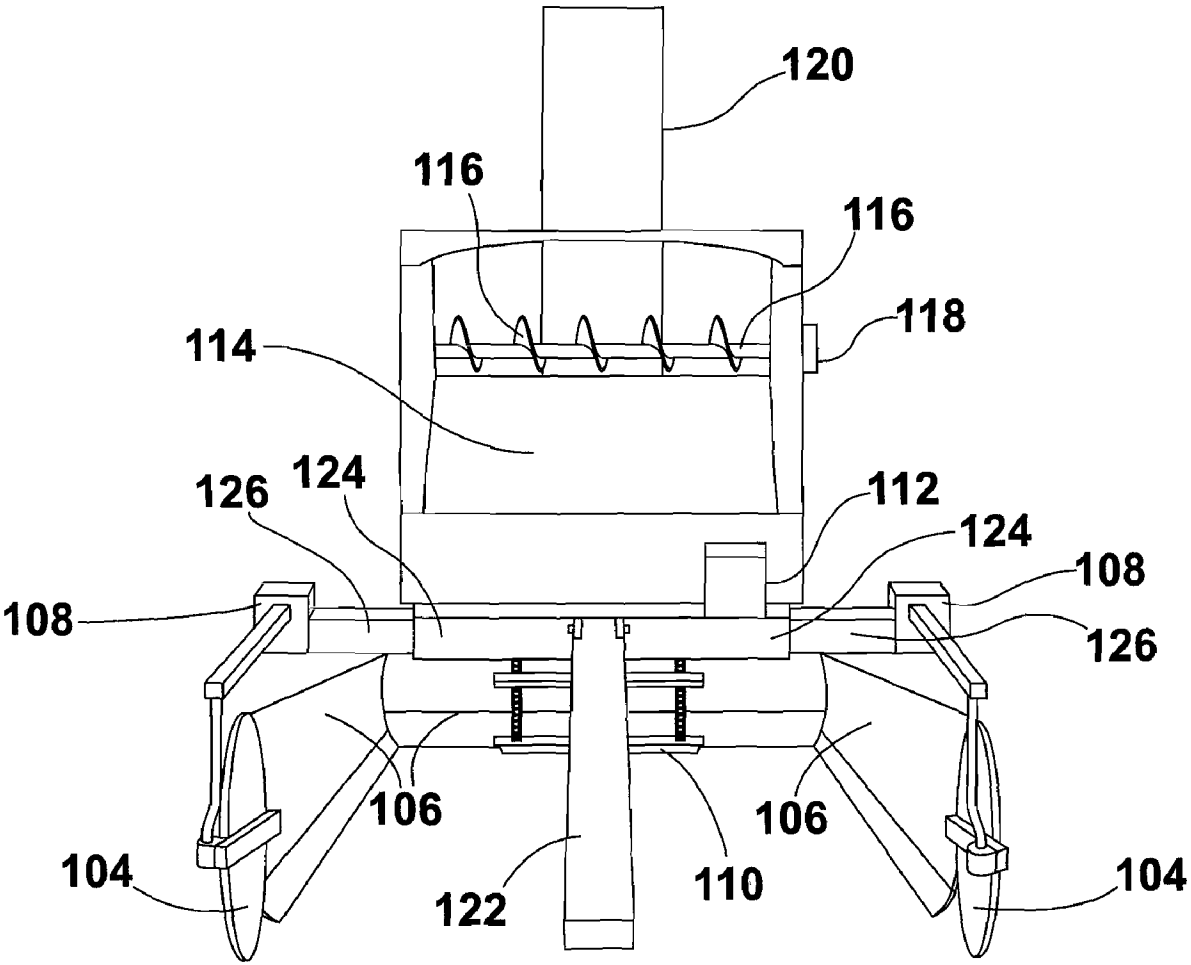
FIG. 2 is a block diagram of a particular illustrative embodiment of a system to cut a path in the ground.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Referring to FIG. 1, an illustrative embodiment of a path cutter that cuts a path for a sidewalk or road is depicted and generally designated 100. The path cutter 100 is attached to a tractor 102 by attachments means 122. In a particular embodiment, the tractor 102 is capable of relatively low speeds, contains hydraulic outlets that can supply sufficient pressure to allow path cutter 100 to function, and contains outputs on the hydraulic and electrical switches of the tractor 102 to facilitate the installation of a bank of controls for the hydraulic lines. The hydraulic outlets are used at least to control the depth the path cutter 100 will cut the path. The deeper the path to be cut, the less the hydraulics are used to support the path cutter 100 and the more the weight of the path cutter 100 is unsupported, resulting in a deeper path cut. The shallower the path to be cut, the more the hydraulics are used to support the path cutter 100 and the more the weight of the path cutter 100 is supported, resulting in a shallower path cut. The depth of the path to be cut is determined by the supported weight of the path cutter 100 and means other than hydraulics may be used to support the path cutter 100.

In a particular embodiment, the tractor 102 contains at least three hydraulic outlets. In another particular embodiment, the tractor 102 contains a hydraulic system that is capable of producing about 30 gallons of hydraulic fluid a minute at about 2800 pounds of pressure. In another particular embodiment, the tractor 102 is a John Deer 6420 with an IVT-transmission and can maintain a relatively slow constant speed with a creeper transmission. The attachments means 122 is of sufficient strength to allow the tractor 102 to pull the path cutter 100.

The path cutter contains a cutting edge 104, a moldboard 106, an adjustment member 108, a first auger 110, a first orbit motor 112, a front conveyor belt 114, a second auger 116, a second orbit motor 118, a rear conveyor belt 120, hydraulic lines (not shown), and electrical lines (not shown). The hydraulic lines and electrical lines are not shown in the interest of clarity and conciseness and one skilled in the art would know the location of the hydraulic and electrical lines. The cutting edge 104 is about 1 foot to about 7 feet in width and is attached to adjustment member 108. In a particular embodiment, the cutting edge 104 is similar to a circular disk that rotates and cuts into the ground as it is pulled or moves along the ground. In another particular embodiment, the cutting edge 104 is similar to a moldboard. In a particular embodiment, the cutting edge 104 is angled such that any earth loosed by the cutting edge 104 is pushed towards the relative center of the path cutter 100. In use, the cutting edge 104 cuts at a depth of at least 20 about 1 inch into the ground. In a particular embodiment, the depth the cutting edge 104 cuts into the ground is dependent on the power of the tractor 102, the amount of hydraulics or other means used to support the path cutter 100, and the conditions of the ground. The cutting edge 104 is used to create a clean smooth edge to the path and helps prepare the ground for moldboard 106.

The moldboard 106 is proximate to the cutting edge 104 and is attached to the adjustment member 108. In a particular embodiment, the side of the moldboard 106 can at least partially overlap the relative center of the moldboard 106. In another particular embodiment, the moldboard 106 is similar to a grater blade and can cut a path at least about 1 inch deep into the ground. The depth of the path into the ground depends on the power of the tractor 102, the amount of hydraulics or other means used to support the path cutter 100, and the conditions of the ground. For example, if most of the path cutter's weight is supported by the hydraulics, then the path is relatively shallow. If very little of the path cutter's weight is supported by the hydraulics, then the path is relatively deep. The moldboard 106 has a curved profile and is thick enough to incur the stress or force of cutting the path. In a particular embodiment, the moldboard 106 is relatively concave or slightly concave. In another particular embodiment, the thickness of the moldboard 106 is at least about ¼ of an inch thick. In a particular embodiment, the moldboard 106 has two leading edges on each side that are curved outward and in use, help remove the earth proximate to 10 the cutting edge 104. The moldboard 106 is angled such that any loose earth weeds, rocks and other material in contact with the moldboard 106 is pushed towards the center of the path cutter 100.

The adjustment member 108 is used to adjust the width of the path being cut. In a particular embodiment, the width of the path depends on how short or how long the width of the moldboard 106 can be adjusted. For example, if the moldboard 106 has three sections of equal length and the outside sections can overlap at least a portion of the middle section, then the width of the path can range from the entire length of the three sections to about ⅓ of the entire length of the three sections because the two outer sections can overlap or slide over the center section. The adjustment member 108 contains an outer tube 124 that is attached to the attachment means 122 and an inner tube 126 that fits inside the outer tube 124. The inner tube 126 is attached to the cutting edge 104 and the moldboard 106. To adjust the width of the path being cut, the inner tube 126 is slid in or out of the outer tube 124 until the desired width is achieved. Then the inner tube 126 is secured to the outer tube 124 such that the inner tube 126 can no longer slide in or out of the outer tube 124.

The auger 110 pushes the earth, weeds, rocks and other material loosened by the cutting edge 104 and the moldboard 106 towards the relative center of the moldboard 106. As the loosened earth weeds, rocks and other material collects or piles up at the moldboard 106, the material rises up on the moldboard 106 and moves towards the front conveyor belt 114. In a particular embodiment, the auger 114 is powered by and operationally connected to the first orbit motor 112.

The front conveyor belt 114 is located behind the cutting edge 104 and the mull board 108 moldboard 106. In a particular embodiment, the front conveyor belt 114 is about 4 feet 5 wide and about 4 feet in length however, the front conveyor belt 114 could be almost any length and width that would allow the path cutter 100 to function and the specific length and width of the front conveyor belt 114 depends on the requirements of the task. In a particular embodiment, the front conveyor belt 114 is located generally at the top center of the moldboard 106. The front conveyor belt 114 collects the earth, weeds, rocks and other 10 material loosed by the cutting edge 104 and the moldboard 106 and carries the earth, weeds, rocks and other material towards the rear conveyor belt 120. The front conveyor belt 114 is angled less than about 45 degrees horizontally. In a particular embodiment, the front of the front conveyor belt 114 is as close to the cut path as operationally possible to catch the material that collected at and overflowed over the moldboard 106. The front 15 conveyor belt 114 is powered by and operationally connected to the orbit motor 112 and the speed of the front conveyor belt 114 can vary depending on the motor used and the specific requirement for the desired task. In a particular embodiment, the front conveyor belt 114 is hydraulically controlled from inside the cab of tractor 102. The front conveyor belt 114 carries the collected material towards the second auger 116 and the rear conveyor belt 120.

In a particular embodiment, the second auger 116 is powered by the second orbit motor 122. The second auger 116 facilitates the transfer the material collected by the front conveyor belt 114 to the rear conveyor belt 120. In a particular embodiment, the second auger 116 pushes the material on the front conveyor belt 114 towards the center of the front conveyor belt 114 and the front conveyor belt 114 carries the material onto the 25 rear conveyor belt 120. In a particular embodiment, the second auger 116 is a combination of a right auger located on the right side of the first conveyor belt 114 and a left auger located on the left side of the first conveyor belt 114.

The rear conveyor belt 120 can be hydraulically rotated about 80 degrees from the proximate center of the path cutter 100 so the loosed material can be discharged to either side of the tractor 102 and off of the cut path. In a particular embodiment, the revolutions per minute of the rear conveyor belt 120 is about ⅓ to about ½ times faster 5 than the revolutions per minute of the first conveyor belt 114. In one embodiment, the material is discharged into a truck for deposit off site and in one experiment, the path cutter filled a typical tri-axel truck in about 10 minutes.

In other embodiments, the mechanism for moving the earth, weeds, rocks and other material loosed by the cutting edge 104 and moldboard 106 may be any mechanism known in the art that would allow the path cutter 100 to function. For example, other means for powering the augers and conveyor belts may be used. In addition, in a particular embodiment, the second conveyor belt 120 may be rotated about 180 degrees from the proximate center of the path cutter 100 such that the second conveyor belt 120 can be stored on the side of the path cutter 100 for relatively easy storage and transport.

The speed of the path cutter 100 is determined at least in part by the desired revolutions per minute of the first conveyor belt 114 and the second conveyor belt 120, the amount of material that can be properly disposed of by the path cutter 100, the conditions of the earth to be cut, and the speed of the tractor 102. In a particular embodiment, the speed of the tractor is controlled by a creeper speed mechanism. Tractor transmissions are designed to produce a larger number of gear ratios within a mechanism located between the engine and the final drive or differential mechanism. In the conventional design, the gear arrangement of the transmission may produce a gear reduction or ratio of approximately 9:1 between the speed of the transmission output and the engine speed. Typically, the torque delivery path of a tractor transmission includes a creeper speed mechanism located behind the transmission gear arrangement and before the differential mechanism. The creeper speed mechanism produces an additional speed reduction of about 5:1 between the output of the transmission gear arrangement and the output of the creeper speed mechanism. This combination of speed ratios can produce an overall speed reduction of approximately 45:1 between the output of the creeper speed mechanism and the engine. In another particular embodiment, the path cutter 100 is able to cut about a 45 degree curve or curves in a path.

Figure 3:
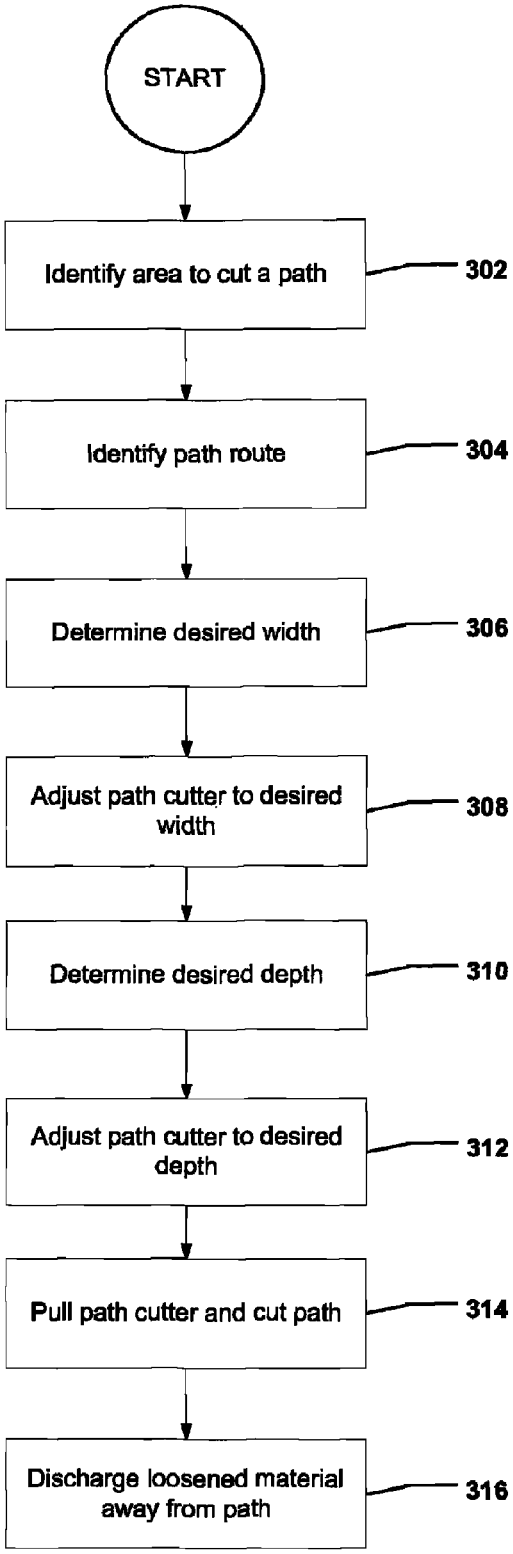
FIG. 3 is a flow diagram of a particular illustrative embodiment of a method of receiving cutting a path in the ground.

FIG. 3 is a flow diagram of a particular illustrative embodiment of a method of creating a path. First, an area to cut a path is identified, Step 302. Then a path route is identified, Step 304. Next the desired width of the path is determined, Step 306. Then, an adjustment member on a path cutter is adjusted to the desired width of the path wherein the adjustment member contains a cutting edge and a moldboard, Step 308. Continuing, the desired depth of the path is determined, Step 310. Next, the proper amount of hydraulics or other amount of support means for the path cutter is determined so the path 10 cutter will cut to the desired depth, Step 312. Then, the path cutter is pulled along the path route to cut the path, Step 314. Continuing, the loosened material on a second conveyor belt of the path cutter is discharged away from the cut path, Step 316.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments can be apparent to those of skill in the art upon reviewing the disclosure. Other embodiments can be utilized and derived from the disclosure, such that structural and logical substitutions and changes can be made without departing from the scope of the disclosure. Additionally, the illustrations are merely representational and can not be drawn to scale. Certain proportions within the illustrations can be exaggerated, while other proportions can be minimized. Accordingly, the disclosure and the figures are to be regarded as illustrative rather than restrictive.

One or more embodiments of the disclosure can be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose can be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features can be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter can be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments that fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A system comprising:
- a tractor; and
- a main body attached to the tractor wherein the main body is pulled by the tractor and comprises:
  - a cutting edge to cut a path at a depth of at least about 1 inch into the ground, to create a smooth edge to the path, and to loosen earth;
  - a moldboard angled such that any earth loosed by the moldboard and the cutting edge is pushed towards the center of the moldboard;
  - an adjustment member attached to the cutting edge and the moldboard such that the width of the path to be cut can be adjusted;
  - a first auger to move the loosed earth to a front conveyor belt; and
  - a second auger to move the loosed earth from the front conveyor belt to a rear conveyor belt.

2. The system of claim 1, wherein the tractor has an IVT-transmission.

3. The system of claim 1, wherein the tractor has a creeper transmission.

4. The system of claim 1, further comprising a hydraulic system wherein the hydraulic system is capable of producing about 30 gallons of hydraulic fluid a minute at about 2800 pounds of pressure.

5. The system of claim 1 wherein the revolutions per minute of the rear conveyor belt is about ⅓ to about ½ times faster than the revolutions per minute of the front conveyor belt.

6. The system of claim 1 wherein the rear conveyor belt can rotate about eighty degrees relative to the proximate center of the main body.

7. The system of claim 1 wherein the system can cut a path with about a forty-five degree angle in the path.

8. A method comprising:
- identifying an area to cut a path;
- identifying a path route in the area to cut a path;
- determining the desired width of the path;
- adjusting an adjustment member on a path cutter to the desired width of the path wherein the adjustment member contains a moldboard and a cutting edge to cut a path at a depth of at least about 1 inch into the ground, to create a smooth edge to the path, and to loosen earth;
- pulling the path cutter along the path route to cut a path, wherein the path cutter contains:
  - the adjustment member;
  - first auger to move material loosened by the cutting edge and moldboard to a first conveyor belt; and second auger to move the loosened material on the first conveyor belt to a second conveyor belt; and discharging the loosened material on the second conveyor belt away from the cut path.

9. The method of claim 8 further comprising determining a desired depth to cut the path and using hydraulics to control the depth of the path.

10. The method of claim 8, wherein the second conveyor belt can rotate about eighty degrees to the right or the left of the proximate center of the path cutter.

11. The method of claim 8, wherein the second conveyor belt can rotate about one hundred and eighty degrees from the proximate center of the path cutter.

12. The method of claim 8, wherein the revolutions per minute of the second conveyor belt are about ⅓ to about ½ times faster than the revolutions pre minute of the first conveyor belt.

13. The method of claim 8 wherein the tractor has an IVT-transmission.

14. The method of claim 8 wherein the desired path width contains at least one about forty-five degree angle.

15. The method of claim 9 wherein the hydraulics are supplied by a tractor that is used to pull the path cutter.

16. An apparatus comprising:

means for adjusting a path cutter to cut a path a predetermined width;

means for adjusting the path cutter to cut the path at a predetermined depth wherein the path is cut by a cutting edge to cut a path at a depth of at least about 1 inch into the ground, to create a smooth edge to the path, and to loosen earth and a moldboard angled such that any earth loosed by the moldboard and the cutting edge is pushed towards the center of the moldboard;

means for propelling the path cutter such that the path is cut at a continuous rate at the predetermined width and the predetermined depth; and means for discharging the material from the cut path as the path is being cut.

17. The apparatus of claim 16 wherein the means for discharging the material from the cut path as the path is being cut is a conveyor belt and the conveyor belt can rotate about eighty degrees relative to the proximate center of the path cutter.

18. The apparatus of claim 16 wherein the means for propelling the path cutter is a tractor with a creeper transmission and the continuous rate is the creeper speed of the tractor.

19. The apparatus of claim 18 wherein the path contains at least one angle of about forty-five degrees.

* * * * *